US006170284B1

(12) United States Patent
Stodt et al.

(10) Patent No.: US 6,170,284 B1
(45) Date of Patent: Jan. 9, 2001

(54) APPARATUS FOR THE CONTROLLED COOLING OF HOT-ROLLED SECTIONS, PARTICULARLY BEAMS, DIRECTLY FROM THE ROLLING HEAT

(75) Inventors: Rolf Stodt, Kaarst; Hans-Peter Drügh, Zülpich-Merz; Holger Behrens; Bruno Böhmer, both of Erkrath, all of (DE)

(73) Assignee: SMS Schloemann-Siemag Aktiengesellschaft, Duesseldorf (DE)

( * ) Notice: Under 35 U.S.C. 154(b), the term of this patent shall be extended for 0 days.

(21) Appl. No.: 09/213,608

(22) Filed: Dec. 17, 1998

(30) Foreign Application Priority Data

Dec. 23, 1997 (DE) ..... 197 57 485

(51) Int. Cl.[7] ..... F25D 17/02
(52) U.S. Cl. ..... 62/373; 62/64
(58) Field of Search ..... 62/63, 64, 373; 72/201

(56) References Cited

U.S. PATENT DOCUMENTS

| | | | | |
|---|---|---|---|---|
| 4,065,252 | * | 12/1977 | Hemsath et al. | 62/64 |
| 4,444,556 | * | 4/1984 | Andersson | 62/64 |
| 4,497,180 | * | 2/1985 | Graham | 62/64 |
| 5,440,889 | * | 8/1995 | Sippel et al. | 72/201 |

FOREIGN PATENT DOCUMENTS

| | | |
|---|---|---|
| 4035893 | 1/1992 | (DE) . |
| 0098492 | 1/1984 | (EP) . |
| 0140026 | 5/1985 | (EP) . |
| 0462783 | 12/1991 | (EP) . |
| 0 578 607 | 1/1994 | (EP) . |
| WO 92/19395 | 11/1992 | (WO) . |

OTHER PUBLICATIONS

Stahl U. Eisen 110 (1990) No. 6, pp 40, "QST Method".
Patent Abstracts of Japan, vol. 012, No. 040 (C–474), Feb. 5, 1988 and JP 62 188726 A (Nippon Kokan KK), Aug. 18, 1997.
Patent Abstracts of Japan, vol. 018, No. 291, (C–1208), Jun. 3, 1994 and JP 06 057327 A (Kawasaki Steel Corp), Mar. 1, 1994.

* cited by examiner

*Primary Examiner*—Ronald Capossela
(74) *Attorney, Agent, or Firm*—Friedrich Kueffner

(57) ABSTRACT

An apparatus for the controlled cooling of hot-rolled sections, particularly beams, directly from rolling heat includes cooling sections or zones, wherein, seen with respect to the section to be cooled, a cooling section each is arranged above the section and on both sides of the section and below the section, and the cooling sections can be used individually or in combination, wherein each cooling section is composed of at least one nozzle or a group of interconnected nozzles, and wherein the nozzles can be controlled individually or together.

12 Claims, 7 Drawing Sheets

APPARATUS FOR THE CONTROLLED COOLING OF HOT-ROLLED SECTIONS, PARTICULARLY BEAMS, DIRECTLY FROM THE ROLLING HEAT

BACKGROUND OF THE INVENTION

1. Field of the Invention

The present invention relates to an apparatus for the controlled cooling of hot-rolled sections, particularly beams, directly from the rolling heat.

2. Description of the Related Art

It is known in the art that the mechanical properties of materials, particularly steel, can be influenced by thermal treatments and/or the addition of alloying elements. However, the unlimited use of the known thermomechanical rolling, particularly when rolling sections, is limited by the load bearing capacity of the roll stands because these methods require high degrees of deformation at comparatively low temperatures.

The mechanical properties can be influenced by the so-called quenching and self-tempering method or QST method. In accordance with this method, the structural components, for example, rolled sections, are quenched after the finishing pass by means of water from the rolling heat. Before the core of the workpiece has cooled, cooling is interrupted and the structure in the border area is tempered by the heat which still is present in the core.

When treating steels, the material surface and the layers below the surface are cooled during the quenching process depending on the cooling duration below the martensite starting temperature which results in the formation of martensite in the border zones. This process can be influenced through the cooling time and the cooling medium; in particular, the depth of the layer in which the martensite is formed, i.e., the penetration depth, is adjusted through the cooling time.

After the end of this forced cooling, the tempering process is carried out in which the previously formed martensite layer is tempered by the residual heat in the section. The temperature once again rises above the martensite starting temperature. This causes the stresses in the martensitic area to be relieved and, thus, a material having high strength with simultaneously good toughness is adjusted.

During the subsequent cooling process in air, bainitic and/or (finely) pearlitic structure is formed in the interior of the cross-section.

If the material is to be cooled without the formation of martensite, the surface of the sections is cooled by adjusting the cooling time and cooling intensity in such a way that the temperature does not drop below the martensite starting temperature. Also in this case, for homogenizing the temperature distribution, tempering is carried out after the end of the forced cooling. After the conclusion of the tempering process, an improvement of the mechanical properties is obtained by the adjustment of, for example, a finely pearlitic and ferritic structure.

It is important for the uniform adjustment of the desired properties that the cooling medium is applied in a specific or targeted manner to the section or the surfaces to be cooled.

An apparatus for cooling beams is disclosed in European Patent 0 140 026. The application of cooling liquid is effected by passing the beams through so-called cooling boxes. These cooling boxes are provided with openings arranged at equal distances for spraying the cooling liquid. For cooling the external and internal areas of the beam, the boxes for the outer surface have at least such a size as it corresponds to the height of the flanges. For cooling the inner flanges, the boxes extend over the entire inner surfaces of the flanges and at least 70% of the web surface. It is possible to influence the bending behavior even in the case of asymmetrical sections.

It has been found to be disadvantageous in this apparatus that an adjustment of the inner cooling boxes is required in the case of different geometries of the sections when the rolling program is changed. In addition, this method can be used predominantly in large beams because a tool is moved from the top and below between the flanges. In the case of small beams, this is not possible or only possible to a very limited extent because of the small available space.

Since the application of cooling water to the beam takes place for all locations of a surface approximately equally and because of the configuration of the cooling boxes individual openings or rows cannot be switched off, it is necessary to have a temperature distribution over the cross-section which is as homogeneous as possible. Consequently, this temperature distribution must be adjusted to a certain extent already during the rolling process by means of a selective cooling of the transition zone between flange and web. In addition, this apparatus is not capable of carrying out cooling so as to reduce the internal stresses of the beam.

European Patent 0 462 783 discloses a method and an apparatus for the thermal treatment of thin-walled I-sections. In this method, a forced cooling of the rolled products takes place between the rolling procedures. The cooling apparatus itself is composed of a plurality of nozzles which are arranged one on top of the other. They are operated with water and can be differently switched on and off. However, the described cooling apparatus only cools the outer sides of the flanges of the sections. This is done with the purpose of cooling the outer surface of the beam prior to the subsequent hot rolling to a temperature of 700° C. or less. By repeating the forced cooling with water, the microstructure of the flange surface is transformed up to a certain depth.

A cooling method and apparatus is also disclosed in European Patent 0 098 492. In that case, an apparatus is proposed for cooling steel sections, specifically rails, which are guided through a cooling apparatus. A variation of the cooling process or local cooling are achieved by different orientations of the rails being transported as well as through baffle plates for the cooling medium.

SUMMARY OF THE INVENTION

Therefore, it is the primary object of the present invention to provide a cooling apparatus for finish-rolled sections, particularly steel beams, which can be adjusted to different geometries and sizes of the sections when the rolling program is changed and which ensures a uniform cooling of the section or the cooling of defined partial areas thereof.

In accordance with the present invention, the cooling apparatus has cooling sections or zones, wherein, seen with respect to the section to be cooled, a cooling section each is arranged above the section and on both sides of the section and below the section, and the cooling sections can be used individually or in combination, wherein each cooling section is composed of at least one nozzle or a group of interconnected nozzles, and wherein the nozzles can be controlled individually or together.

Accordingly, the gist of the invention is the adjustment of a spraying pattern of the cooling apparatus which is adapted in an optimum manner to different section geometries by providing the cooling apparatus with cooling sections or zones, wherein a cooling section each is arranged above, below and on both sides of the section, wherein the cooling sections can be used individually or in combination. Each cooling section is composed of at least one nozzle or interconnected nozzles, wherein the nozzles can be controlled individually or together, so that the individual cooling sections are controllable.

The adjustment of the cooling effect is achieved in particular by a variation of the distance of the nozzles from the section, by a controlled adjustment of the spraying pressure, by making the individual nozzles infinitely variably rotatable, and by switching individual nozzles on or off.

In addition to the adaptation to the section geometry, by using the variation of the nozzle distance and the nozzle pressure it is possible to adjust the heat transfer coefficient required for a successful cooling of a section. The adjustment of the desired spraying pattern is additionally achieved through the rotatability of the nozzles and by switching on or off individual nozzles or groups of interconnected nozzles.

Each group of interconnected nozzles is composed of several nozzles whose outlet openings define a plane or form a straight line. A flexible adjustment of the cooling apparatus is achieved by the differently configured groups of interconnected nozzles in the form of surfaces or nozzle rows and the high variability of the nozzles, wherein the various partial surfaces of the sections can be cooled differently and the cooling power can be adapted to the requirements.

The apparatus according to the present invention makes it possible to adjust a simultaneous structure transformation in the material of shaped rolled sections in spite of a different temperature distribution over the cross-section after leaving the rolling train. In particular, it is possible to carry out the forced cooling of the QST method uniformly over the entire workpiece. It is ensured that the border zones of the steel sections are composed after the cooling process of tempered martensite over a certain depth from the surface and of pearlite and/or ferrite in the core zone.

The cooling apparatus proposed according to the present invention makes it possible to cool differently shaped sections which successively travel through the apparatus without having to reassembly the apparatus.

In addition, it is possible to continuously realize different cooling strategies without having to reassemble the apparatus. These cooling strategies include cooling processes for minimizing internal stresses in the workpiece body by a simultaneous structure transformation in the material as well as cooling processes for adjusting a pearlitic structure.

It has been found to be advantageous that there are no tools between the flanges of the sections. The rotatable nozzle supports and the flexible controls of the nozzles make it possible to adapt the cooling apparatus in an optimum manner to the dimensions of the beam or section.

The possibility of the optimum adjustment resulting from the high variability of the individual nozzles ensures that cooling medium is not sprayed past the area to be cooled. This ensures a high cooling power, avoids losses of cooling medium, and no interference effects of other nozzles units are caused.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
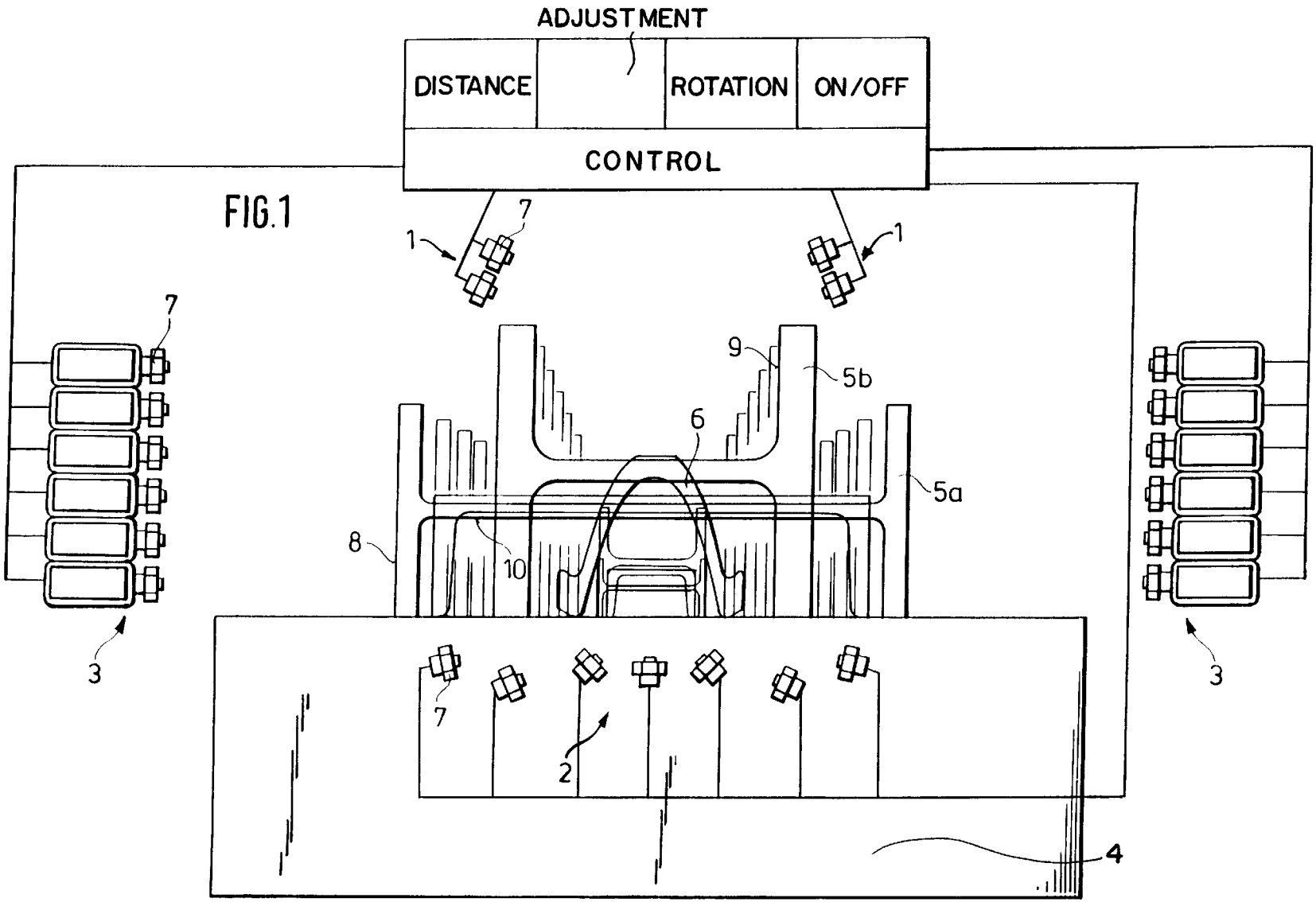
FIG. 1 is a cross-sectional view of the cooling apparatus according to the present invention.

FIG. 1 of the drawing is a cross-sectional view of the overall arrangement of the cooling apparatus according to the present invention including an upper cooling section 1, a lower cooling section 2 and lateral cooling sections 3. The rolling stock to be cooled is guided over a roller conveyor 4 from the rolling mill after the finishing pass through the cooling apparatus. Individual nozzles 7 are arranged in groups of interconnected nozzles along the longitudinal direction or travel direction of the schematically illustrated I-beams of different gradations and types 5*a* and 5*b* as well as sections, particularly a section 6 for mining.

Figure 2:
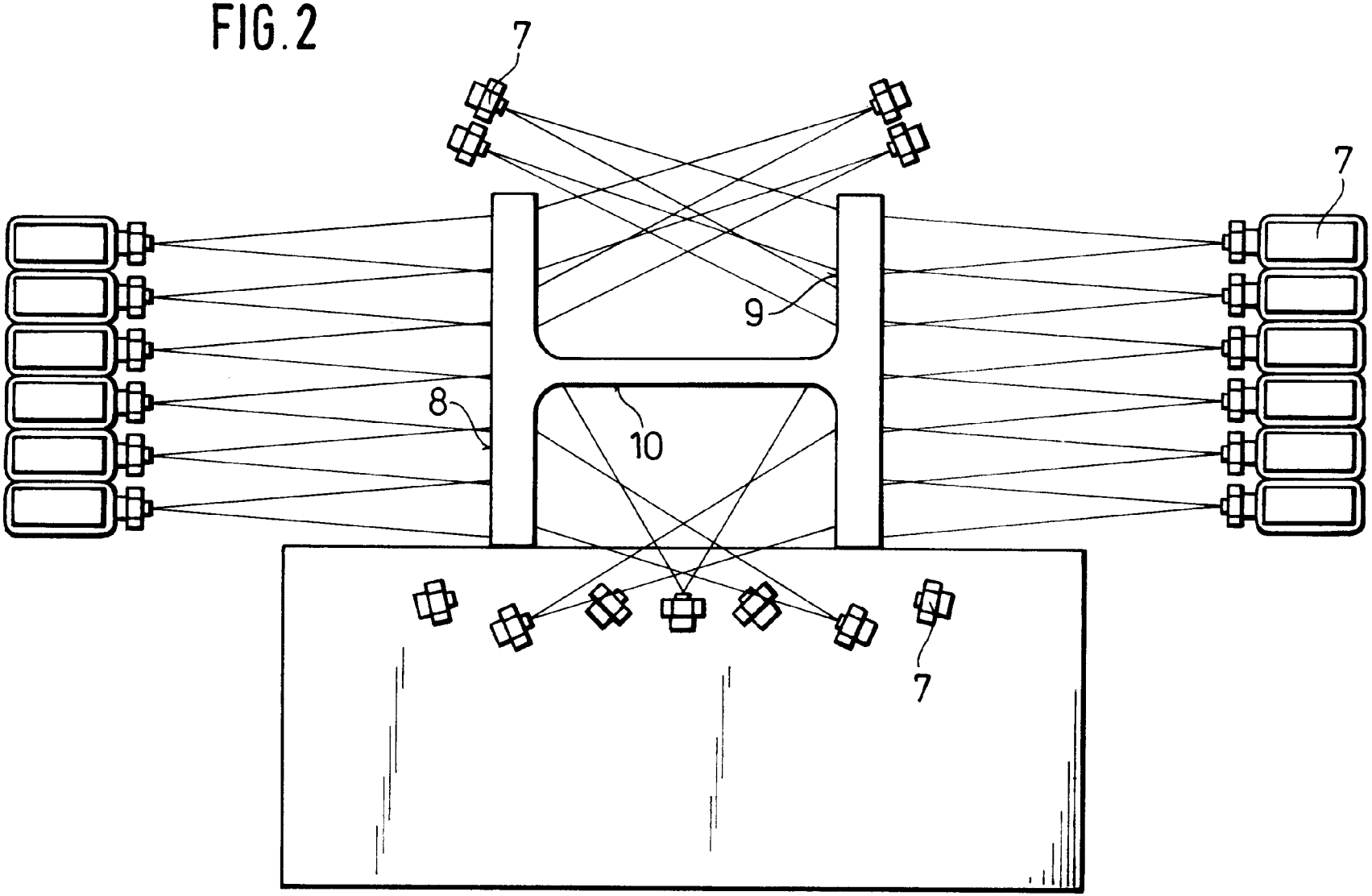
FIG. 2 is a schematic illustration corresponding to FIG. 1 showing the spraying angles for a I-beam.

The spraying angles are schematically illustrated in FIG. 2 as used for an I-beam.

When cooling an I-beam, the laterally arranged nozzles serve for cooling the outer flanges 8, while the upper nozzles cool the inner sides 9 of the flanges. The lower inner sides of the flanges and the lower surfaces 10 are covered by the spray jets of the nozzles of the lower cooling section.

Depending on the section to be cooled, the quantity of cooling medium being sprayed is adapted to the section size and shape by switching on or off the nozzles over the cross-section and in the longitudinal direction, without having to carry out a tool change. Consequently, it is possible to create a spray pattern which is adapted in an optimum to the section, and the individual sections of a row of sections can be cooled without losses which would be caused by spraying past the section.

The individual nozzles 7 are mounted in points of rotation located outside of the section dimensions of a group of sections and can be optionally rotated infinitely variably or they are mounted in a fixed position.

In accordance with a preferred embodiment, the groups of interconnected nozzles for cooling the outer sides of the flanges are mounted so as to be rotatable and/or shiftable. The nozzles for cooling out of the roller conveyor are arranged so as to be fixed.

Consequently, in particular in the case of I-beams, cooling medium can be admitted to all vertically extending inner sides of the flanges of a series of sections by changing the nozzle angles and, thus, the spray angles, and by a suitable selection of the nozzles which are in use, such that the distance between the nozzle and inner surface of the respective flange is essentially equal. As a result, this uniform distance for all beams result in equal cooling effects.

Figure 3:
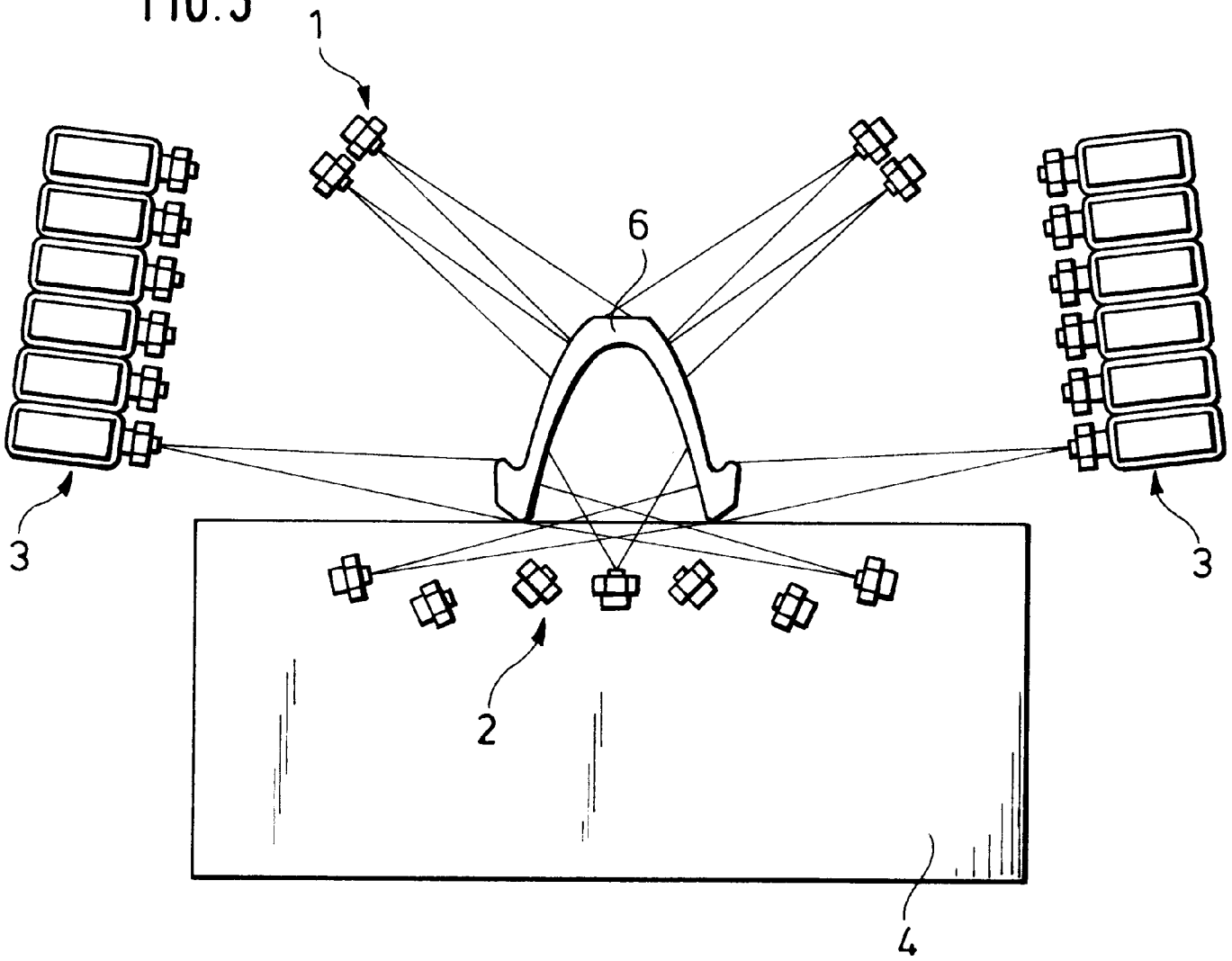
FIG. 3 is a schematic illustration corresponding to FIG. 1 showing the spraying angles for a section used for mining.

The cooling apparatus proposed in accordance with the present invention is not only used for steel beams of different gradations and different types. This cooling apparatus is particularly suitable for sections having more complicated shapes. FIG. 3 shows the adjustment of the nozzles in the case of a section 6 used for mining. Each partial surface of the section can be cooled in a defined manner by a controlled use of only certain nozzles and certain angles.

Figure 4:
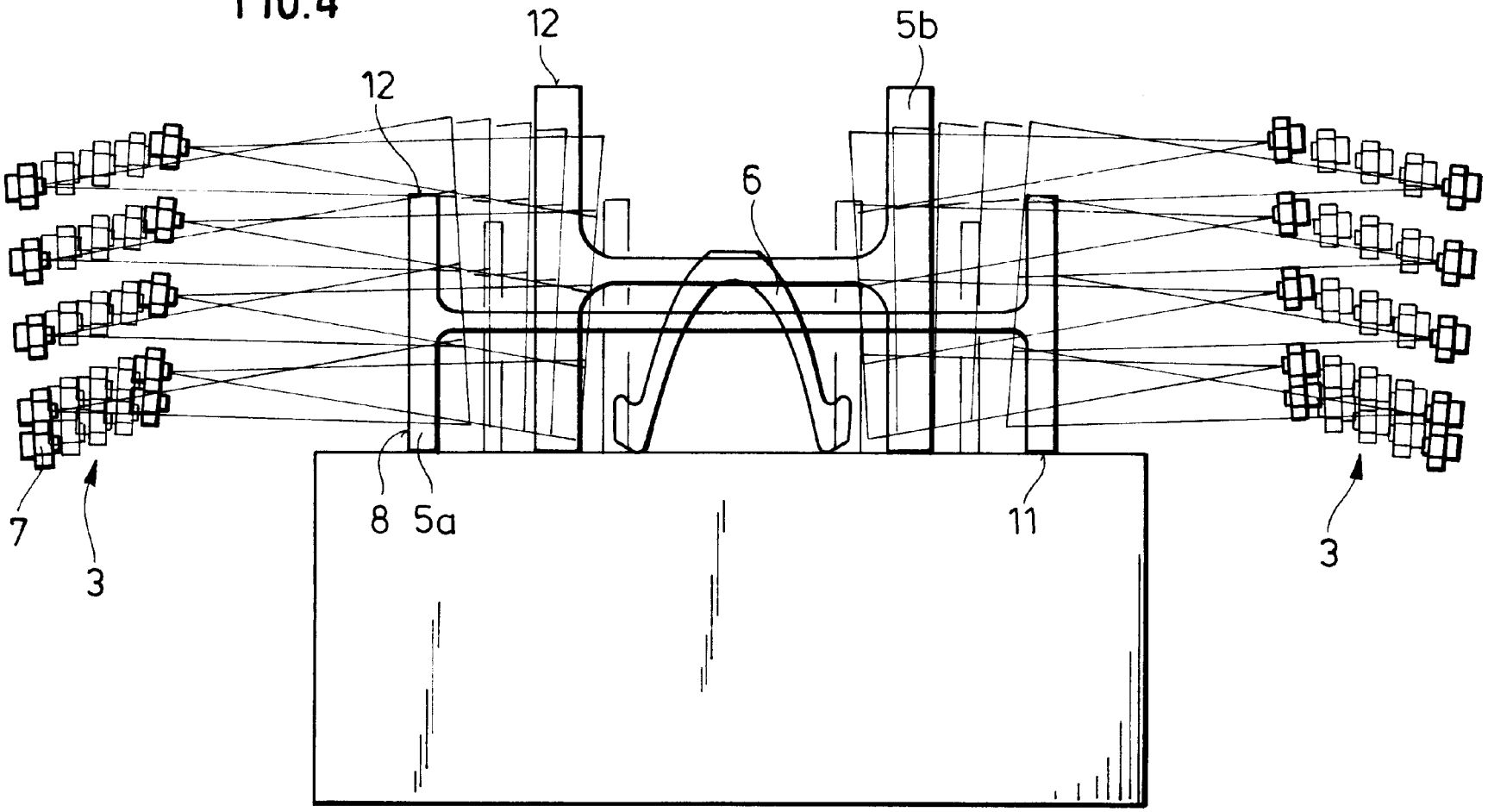
FIG. 4 is a schematic illustration of the apparatus showing the angular adjustment of the nozzles for cooling the outer sides of the flanges of an I-beam.
Figure 5:
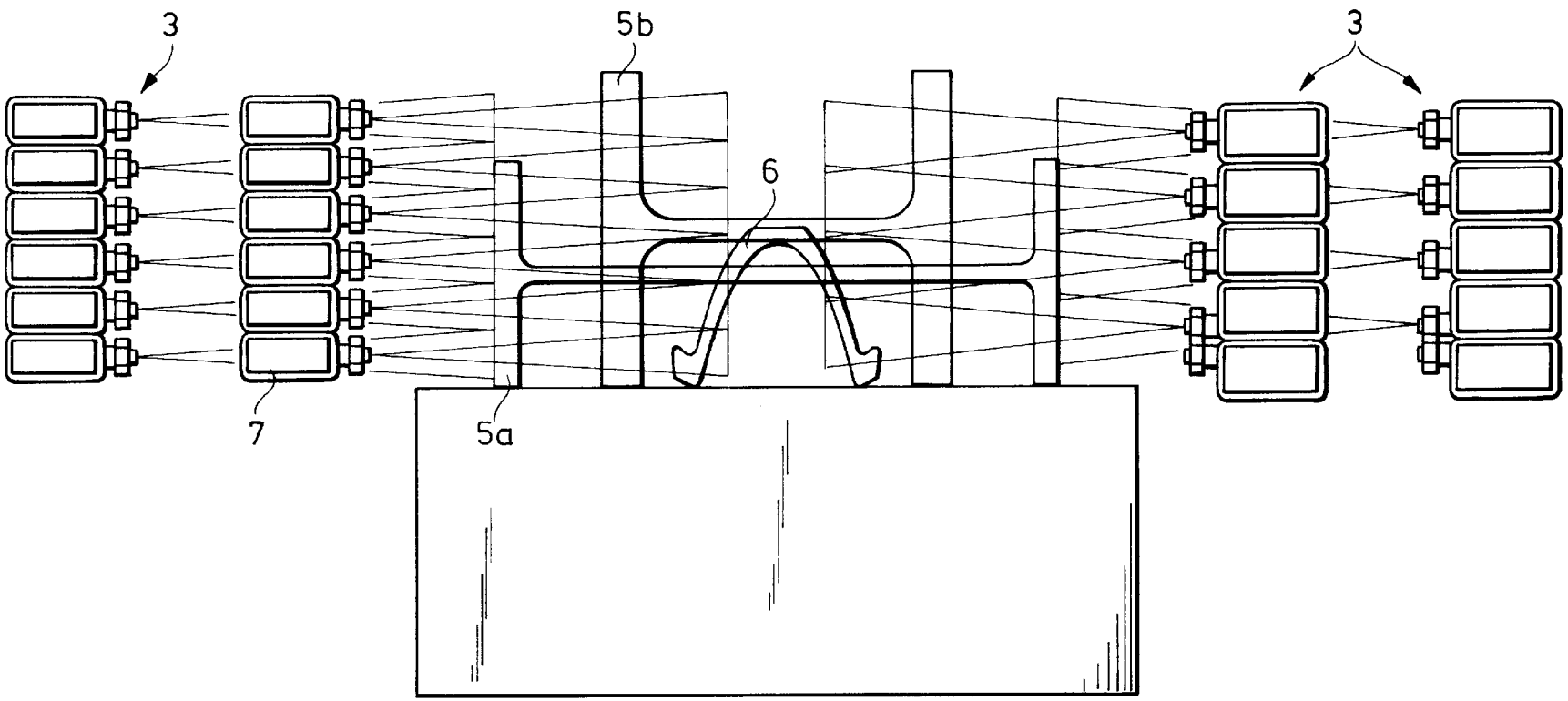
FIG. 5 is a schematic illustration of the apparatus showing the linear guidance of the nozzles for cooling the outer sides of the flanges of an I-beam.

In the case of I-beams, a controlled cooling of the outer sides 8 of the flanges is achieved by an angular adjustment of the nozzles, as shown in FIG. 4, or by a horizontal linear guidance of the nozzles, as shown in FIG. 5.

FIG. 4 schematically shows the manner in which the positions of the respective nozzles 7 of the lateral cooling sections 3 and the angles thereof are adjusted for two I-beams of different types 5*a* and 5*b* and of different sizes, and for a section 6 used for mining. The angular adjustment is achieved by effecting cooling of the outer sides 8 of the flanges by several nozzles 7 which are arranged one above the other and which are mounted in points of rotation located outside of the section dimensions of a group of sections and can be rotated in an infinitely variable manner.

The apparatus can be adjusted in such a way that as a result of the large radius thereof it can be adapted to the lower edge of all possible sections in such a way that spraying is not carried out past the flange.

When successively processing a variety of sections, the lower edge 11 of the I-beams or sections is fixedly defined in the vertical direction by the position thereof on the conveying means, while the vertical level of the upper edge 12 varies. By the rotatability of the nozzle arrangement, the cooling system according to the present invention makes it possible to adapt the spraying pattern to the changing upper edges without changing the cooling effect at the lower edges.

In addition to the angular adjustment, it is also conceivable to vary the cooling effect and the spraying pattern by a linear guidance of the nozzle arrangement. FIG. 5 shows in a schematic cross-sectional view a lateral nozzle arrangement or section 3 which continues in the longitudinal direction. The entire nozzle arrangement can be displaced horizontally. The spraying effect is achieved by the distance to be adjusted, the number of nozzles 7 and the targeted switching on and off of individual nozzles. An adaptation to the respective beam 5*a*, 5*b* or section 6 takes place through the nozzle angle which depends on the distance between the beam flange and nozzle. The cooling power or the thermal transfer coefficient is adjusted through the variation of the nozzle pressure. It is conceivable to combine the functions of angular adjustment and linear guidance.

Figure 6A:
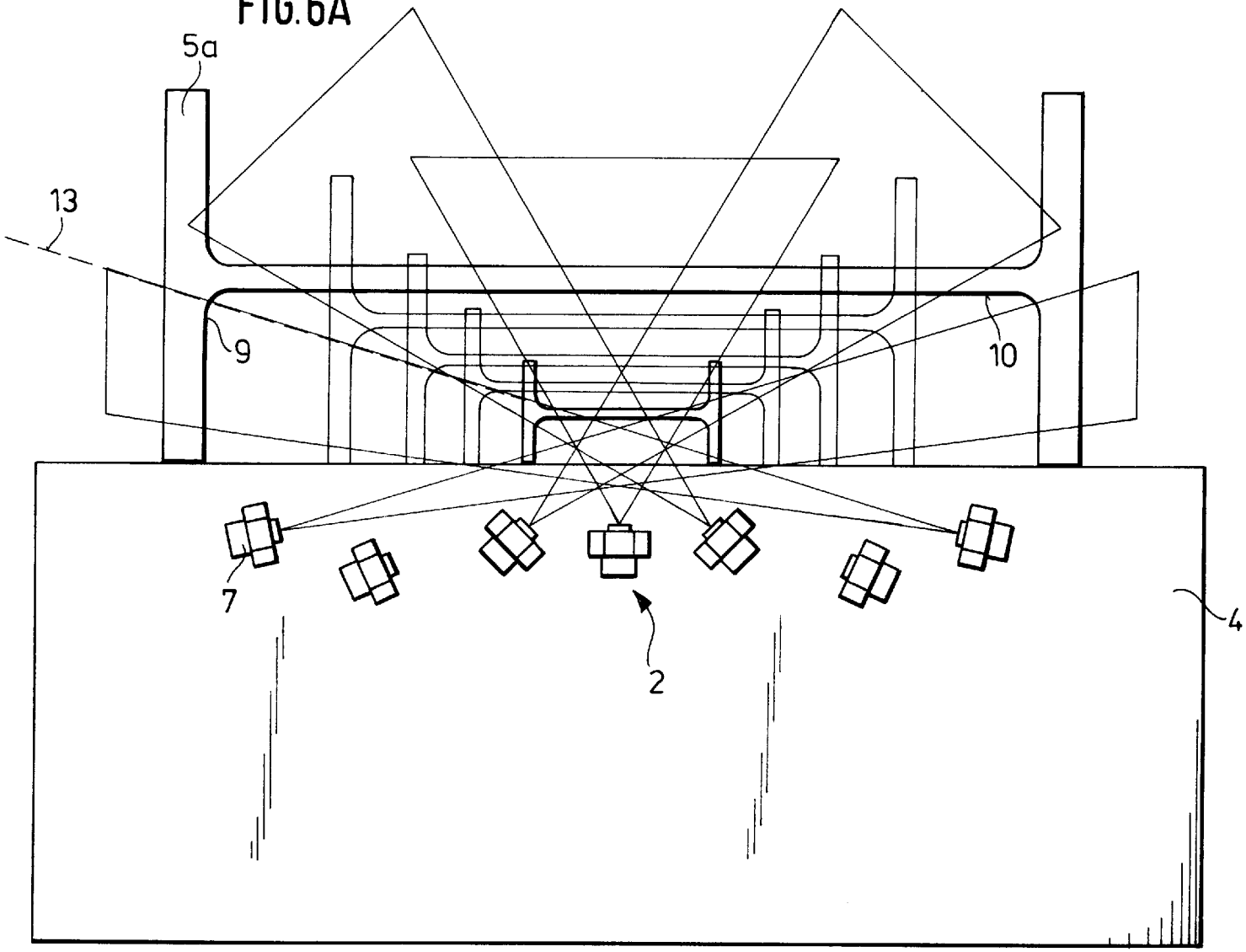
FIGS. 6*a* and 6*b* illustrate the defined use of nozzles in the case of different section sizes and types.
Figure 6B:
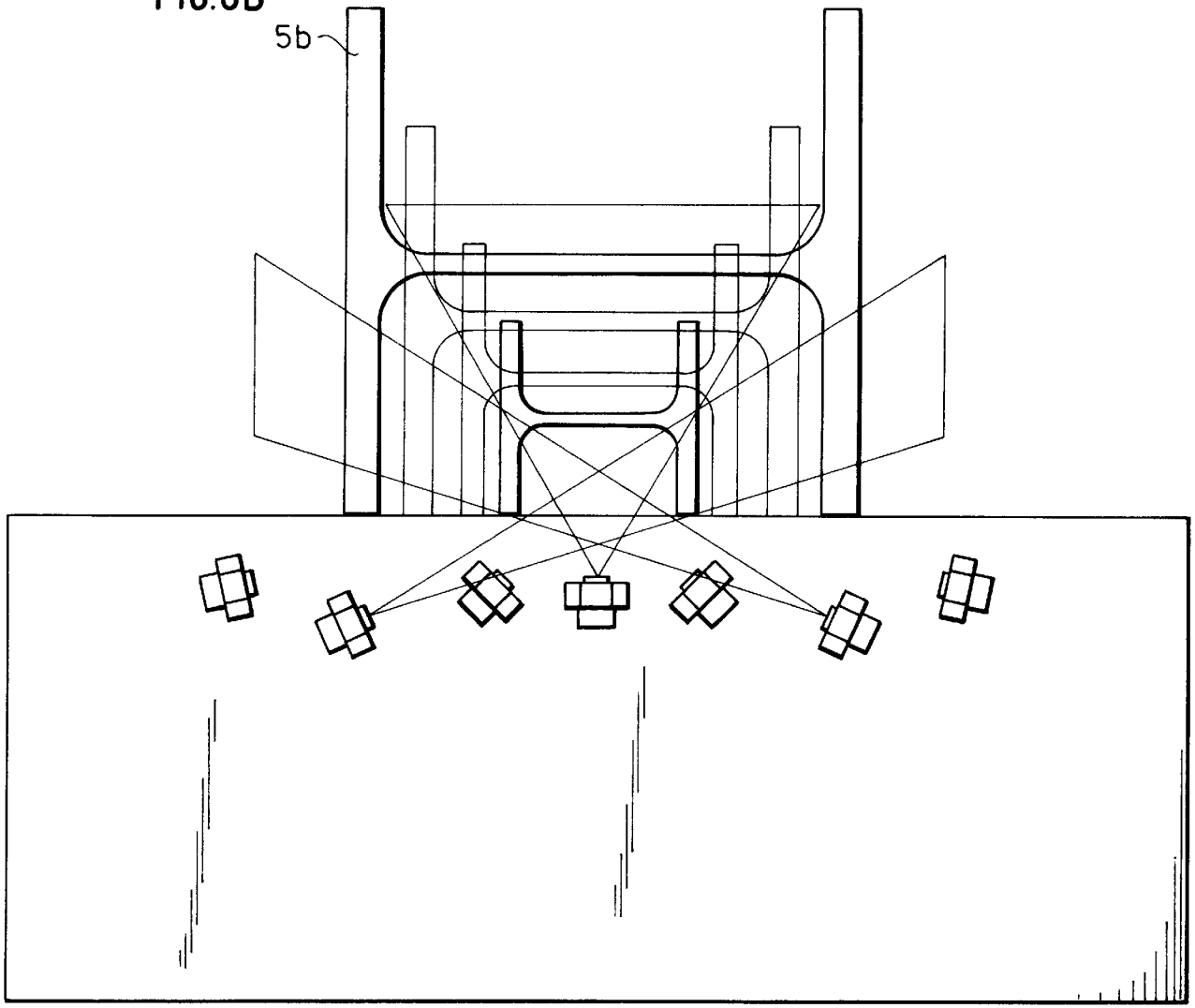

FIGS. 6*a* and 6*b* illustrate cooling of the bottom sides of an I-beam by means of nozzles of the lower nozzle section or arrangement 2 whose nozzles are arranged between the rollers of the roller table. It is apparent that the nozzle arrangement can be adapted to different section sizes and section types with differently large web areas and corresponding flange portions.

FIG. 6*a* shows that in the case of beams 5*a* with wider web areas the outer as well as the central nozzle rows are used, while in the case of beams with shorter web portions 5*b* an optimum spraying effect is achieved by the middle rows, as illustrated in FIG. 6*b*. Consequently, an optimum cooling effect can be achieved in a specific manner by switching particular nozzles on or off.

It has been found to be advantageous if the outer edge of the spraying range of that spray jet which sprays against the inner side 9 of the flange and the web portion adjacent the inner side of the flange extends parallel to an imaginary, essentially straight, connecting line 13 of the transition areas between the inner side of the flange and the web area of all sections of one type but of different sizes.

The apparatus according to the present invention cannot only be used for I-beams or sections used for mining. It is also possible to use the apparatus for rail or angle sections.

While specific embodiments of the invention have been shown and described in detail to illustrate the inventive principles, it will be understood that the invention may be embodied otherwise without departing from such principles.

We claim:

1. An apparatus for controlled cooling of hot-rolled sections directly from rolling heat, the apparatus comprising a nozzle arrangement comprised of nozzles with outlet openings for spraying cooling medium against the sections, and means for conveying the sections along the nozzle arrangement, the nozzle arrangement comprising an upper cooling section above the sections to be cooled, a lower cooling section below the sections to be cooled and two lateral cooling sections arranged laterally of the sections to be cooled, wherein each cooling section has at least one nozzle or a group of interconnected nozzles, further comprising control means connected to the upper, lower, and two lateral cooling sections for controlling the upper, lower and two lateral cooling sections individually or in combination and for controlling the nozzles individually or a group of interconnected nozzles so as to adjust a spraying pattern and a cooling effect of the upper, lower, and two lateral cooling sections according to a shape of a hot-rolled section to be cooled.

2. The apparatus according to claim 1, wherein the control means comprise means for varying a distance of the nozzles from the sections, means for a controlled adjustment of the spray pressure, means for infinitely variably rotating the individual nozzles, and means for switching the individual nozzles on or off.

3. The apparatus according to claim 1, wherein each group of interconnected nozzles is comprised of a plurality of nozzles, wherein the outlet openings of the nozzles define a plane.

4. The apparatus according to claim 1, wherein each group of interconnected nozzles is comprised of a plurality of nozzles, wherein the outlet openings of the nozzles are located on a straight line.

5. The apparatus according to claim 1, wherein the nozzles of the cooling sections are arranged outside of an area defined by a largest of a group of sections to be processed.

6. The apparatus according to claim 1, wherein the lower cooling section is arranged underneath the means for conveying the sections.

7. The apparatus according to claim 6, wherein the means for conveying the sections is a roller table.

8. The apparatus according to claim 1, wherein each lateral cooling section is configured to be displaceable horizontally relative to the section.

9. The apparatus according to claim 8, wherein the nozzles of each lateral cooling section are arranged individually or together on a moveable structural component.

10. The apparatus according to claim 1, wherein the sections are I-beams each having a transition area between an inner side of a flange and a web of the beam, and wherein an outer edge of a spraying range of a spraying jet which is directed toward the inner sides of the flange and a web area adjacent to the inner side of the flange extends parallel to an imaginary connecting line between the transition areas of all beams of a group of beams being processed.

11. The apparatus according to claim 1, wherein the cooling medium is water.

12. The apparatus according to claim 1, wherein the cooling medium is an aerosol.

* * * * *